US006966552B2

(12) United States Patent
Trovinger et al.

(10) Patent No.: US 6,966,552 B2
(45) Date of Patent: Nov. 22, 2005

(54) BINDING SYSTEM WITH SHEET-WISE FORMATION OF FEATURES

(75) Inventors: Steven W. Trovinger, Los Altos, CA (US); Ross R. Allen, Belmont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 46 days.

(21) Appl. No.: 09/934,725

(22) Filed: Aug. 20, 2001

(65) Prior Publication Data

US 2002/0168247 A1 Nov. 14, 2002

Related U.S. Application Data

(63) Continuation-in-part of application No. 09/831,768, filed on May 14, 2001.

(51) Int. Cl.[7] ..... B26D 5/02

(52) U.S. Cl. ..... 270/52.17; 83/405; 83/934; 83/904; 412/16

(58) Field of Search ..... 83/904, 414, 405, 83/406, 934; 270/52.16, 52.17, 52.18; 412/16

(56) References Cited

U.S. PATENT DOCUMENTS

| | | | | | |
|---|---|---|---|---|---|
| 4,072,076 | A | * | 2/1978 | Miles | 83/300 |
| 4,106,148 | A | | 8/1978 | Axelrod | |
| 4,221,373 | A | | 9/1980 | Muller Hans | |
| 4,466,603 | A | * | 8/1984 | Schnell | 270/58.33 |
| 4,484,501 | A | | 11/1984 | Ramcke | |
| 4,504,336 | A | | 3/1985 | Talalay | |
| 4,575,296 | A | | 3/1986 | Kockler et al. | |
| 4,595,187 | A | | 6/1986 | Bober | |
| 4,795,071 | A | | 1/1989 | Jacobs et al. | |
| 4,819,021 | A | * | 4/1989 | Doery | 399/382 |
| 4,891,681 | A | * | 1/1990 | Fiske et al. | 399/385 |
| 5,028,193 | A | | 7/1991 | Misicka | |
| 5,158,273 | A | * | 10/1992 | Wagner | 270/52.17 |
| 5,297,784 | A | * | 3/1994 | Wagner | 270/52.17 |
| 5,377,965 | A | * | 1/1995 | Mandel et al. | 270/37 |
| 5,492,315 | A | * | 2/1996 | Maruyama et al. | 270/58.32 |
| 5,632,587 | A | | 5/1997 | Coyette | |
| 5,662,318 | A | | 9/1997 | Harada et al. | |
| 5,803,891 | A | | 9/1998 | Haan et al. | |
| 6,099,225 | A | | 8/2000 | Allen et al. | |
| 6,193,457 | B1 | * | 2/2001 | Pacione | 412/1 |

FOREIGN PATENT DOCUMENTS

| | | | | | |
|---|---|---|---|---|---|
| DE | 2300518 | A | * | 7/1974 | B26D/3/14 |
| DE | 2803385 | A1 | | 8/1979 | |
| DE | 3543132 | A | * | 6/1987 | B26D/3/14 |
| EP | 0364730 | A | | 4/1990 | |
| GB | 2184189 | A | * | 6/1987 | F16P/3/14 |
| JP | 2000006087 | A | * | 1/2000 | B26D/1/08 |
| WO | WO 9324286 | A1 | * | 12/1993 | B26D/3/14 |
| WO | WO 9402332 | A1 | * | 2/1994 | B42F/21/12 |
| WO | WO 00/18583 | | | 4/2000 | |
| WO | WO 40425 | A1 | * | 7/2000 | B42B/4/00 |

* cited by examiner

*Primary Examiner*—Patrick Mackey

(57) ABSTRACT

The system and method for binding documents as described creates documents having features such as tabs, finger indexes, tear-out cards, and windows. These features are desirable for both their appearance and functionality and are easily added to a document during sheet-by-sheet processing. A sheet-wise binding system includes a sheet transport path for transporting a plurality of printed sheets in a sheet-wise manner and a punch configured to punch a feature into at least one of the sheets traveling through the sheet transport path. A stacking system is provided for stacking the punched and unpunched sheets and a binding system for binding the stacked sheets is used to form a finished document. A controller is programed to control the sheet transport path and the punch to create the features in selected sheets and at selected locations in the sheets according to a punch schedule.

28 Claims, 2 Drawing Sheets

BINDING SYSTEM WITH SHEET-WISE FORMATION OF FEATURES

CROSS-REFERENCE TO RELATED APPLICATION

This application is a continuation-in-part of U.S. application Ser. No. 09/831,768 filed May 14, 2001 which is incorporated herein by reference in its entirety.

BACKGROUND OF THE INVENTION

1. Field of the Invention

The invention relates to a binding system for creating documents with sheet-wise formation of document features, and more particularly, the invention relates to a sheet-wise punching system for creating features such as tabs and finger indexes in the sheets of a document.

2. Background Information

Automated saddle stitch booklet makers are currently used to bind many sheets of duplex printed material into a finished booklet. The currently known booklet making machines perform operations such as stapling, folding and trimming of sheets. Generally these booklet making machines perform these functions on many sheets at a time requiring high forces, powerful motors, and dangerous cutting devices. Such booklet making machines are expensive, often exceeding the cost of desktop or office printers. As such, known booklet making machines are not well suited for use in low cost desktop booklet making.

Accordingly, there is a need for electronic desktop publishing machines for forming booklets which are compact, low cost, high quality and suitable for use with desktop laser and ink jet printers.

In conventional booklet making machines the booklets are first assembled, stapled, and folded and then the edges of the sheets are trimmed together to achieve a finished and flush edge to the sheets. The final trimming process for formation of books may also include the addition of trimmed features to the edges of the sheets, such as indexing tabs and/or finger indexes. However, the trimming of the sheets of an entire book at one time to form these indexing features requires complicated and expensive trimming equipment increasing the cost and size of a booklet maker.

U.S. Pat. No. 6,099,225 describes a booklet maker and a booklet making process in which sheets are trimmed by an individual sheet trimming operation to reduce the force needed for trimming. According to this booklet making process, the sheets are trimmed to length first and, then folded, assembled, and stapled. The trimming of individual sheets allows the use of smaller and less expensive trimming systems for edge trimming.

However, it would be desirable to provide a booklet maker which can take advantage of sheet-wise trimming with the additional option to perform trimming of individual sheets to create features, such as indexing tabs, finger indexes, tear out cards, and windows.

SUMMARY OF THE INVENTION

The present invention relates to a sheet-wise binding system and a method of binding sheets in which features are punched into sheets in a sheet-wise manner prior to binding the sheets into a book or booklet.

In accordance with one aspect of the present invention, a sheet-wise binding system includes a sheet transport path for transporting a plurality of printed sheets in a sheet-wise manner, a punch configured to punch a feature into at least one of the sheets traveling through the sheet transport path, a stacking system for stacking the punched and unpunched sheets, and a binding system for binding the stacked sheets to form a finished document. A controller is programed to control the sheet transport path and the punch to punch the feature in some of the sheets and not punch the feature in others of the sheets according to a punch schedule.

In accordance with another aspect of the present invention, a method of binding sheets includes the steps of delivering a plurality of sheets to a punch in a sheet-wise manner; punching at least one of the sheets with the punch to form a feature according to a punching schedule; stacking punched and unpunched sheets from the punch; and binding the stacked sheets to form a document.

In accordance with a further aspect of the present invention, a sheet-wise binding system includes a sheet transport path for transporting a plurality of printed sheets in a sheet-wise manner, a trimmer configured to trim the edges of the sheets traveling through the sheet transport path to form a saw tooth edge feature, a stacking system for stacking the trimmed sheets, and a binding system for binding the stacked sheets to form a finished document. A controller is programed to control the sheet transport path and the trimmer to trim the edges of the sheets at a varying location according to a trim schedule to create the saw tooth edge feature.

The present invention provides the advantage of a more compact and less expensive apparatus for use in creating features, such as indexing tabs and finger indexes in a book or booklet.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

The present invention relates to systems and methods for the creation of documents having features, such as tabs, finger indexes, tear out cards, and windows. The finger indexes formed by the present invention are the type which are often found in large dictionaries to allow a user to open to a particular section of the book. These finger indexes are desirable for both their decorative appearance and functionality and yet finger indexes are primarily found in expensive books due to the complex procedures for making these features. The present invention allows these finger indexes and other features to be made at a lower cost for incorporation in all kinds of documents.

The tabs, windows, and tear out card features formed by the present invention are particularly useful for reports, manuals, brochures, and other documents. Windows may be used for viewing a title through a front cover of a document. Tabs are used for indexing of chapters or sections. Tear out cards are commonly used to allow envelopes and postcards to be removed from a document without damaging the document. All of the punched features formed by the present invention are formed in a sheet-by-sheet or sheet-wise manner prior to binding of the sheets into a final document. In contrast, known punching methods for forming features are performed on a finished document all at once. Alternatively, some known methods require that separately prepared sheets be collated into a document prior to binding. The sheet-by-sheet formation of the punched features of the present invention can be added to a desktop publishing booklet making system with minimal additional hardware and cost. Examples of the types of booklet making systems for which the present invention is particularly useful are described in U.S. Pat. No. 6,099,225, which is incorporated herein by reference in its entirety.

Figure 1:
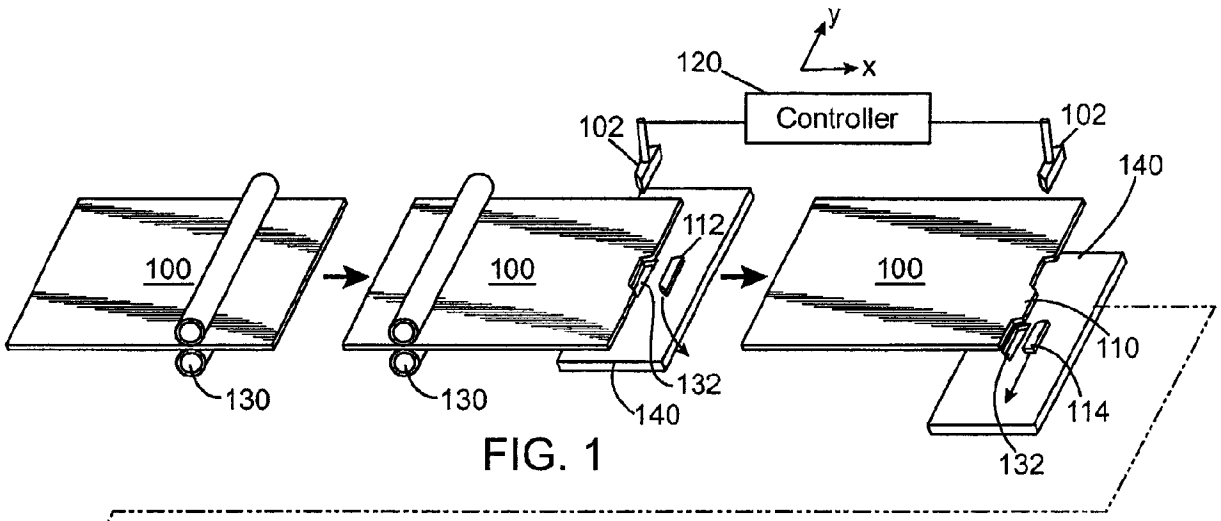
FIG. 1 is a perspective view of steps of formation of a tab feature on a document sheet.

FIG. 1 illustrates the steps for forming one or more tabs on a document sheet by punching and/or cutting away excess material to form the tabs. As shown in FIG. 1, a sheet 100 is passed along a sheet transport path by a precision paper drive 130 to a punch 102 used to form a tab 110 on a leading and/or trailing edge of the sheet. The punch 102 first punches material 112 at a first side of a tab 110. In a second punching step the punch 102 is moved in a Y direction to punch material 114 at second side of the tab 110. After punching both sides of the tab 110, a remainder of the excess material 116 is removed by either the punch 102 or by another cutter to create an edge of the sheet 100 with a flush edge except for the extending tab 110. The punched and trimmed excess material 112, 114, 116 cut by the punch and/or cutter is discarded. The removal of the excess material 116 which is not cut by the punch is preferably removed by a rotary or other paper trimming cutter which is a part of the sheet trimming hardware of the booklet maker.

The tab formation process of FIG. 1 is performed on a printed set of sheets with some of the sheets being punched to form tabs and some of the sheets being trimmed without the formation of tabs. The printer prints information on the sheets at a known location which will become the tab 110. Information about the location of the printed information is communicated to the binding system for formation of the tab 110 at a desired location so that the printed information appears on the tab.

According to one embodiment, the punching operation for formation of the tabs 110 is performed once the sheet has been positioned at a desired punch position in the sheet transport path by the precision paper drive 130. The sheet 100 is preferably movable in an X direction substantially perpendicular to the edge on which the tab is to be formed and the punch 102 is preferably movable in a Y direction substantially parallel to the edge. The controlled motion of the sheet in the X direction locates the paper so that the cutting edge of the punch 102 is at a specified location to form the edge of the finished document. The motion of the punch in the Y direction locates the tab and allows the punch to move to both sides of the tab 110 for punching sheet material at both sides of the tab. Alternatively, the punch 102 may be movable in both the X and Y directions to position the tab 110.

Alternatively, the punching may be performed by more than one punch 102, the punch may be fixed, and/or the sheet may be moved through one or more of a plurality of punching stations. According to a further alternative embodiment, the punching operation may be performed by a single punch extending along the whole or a part of the edge and having a tab shaped cut out.

The punch 102, the sheet transport path, and associated sheet advancing mechanisms 130 are controlled by a controller 120. The controller 120 is programed with information about the sheet numbers which are selected to receive tabs 110 and the locations of the tabs on the sheets.

The punching system according to the present invention may include a polygonal shaped punch 102 and a punch plate 140 having a cut out 142 with a shape corresponding to the shape of the punch 102. In accordance with the embodiment illustrated in FIG. 1, the punch 102 and punch plate 140 are movable in the Y direction in a coordinated manner. Alternatively, the punch plate 140 may be a fixed plate having a plurality of holes 142 to receive the punch 102.

Figure 2:
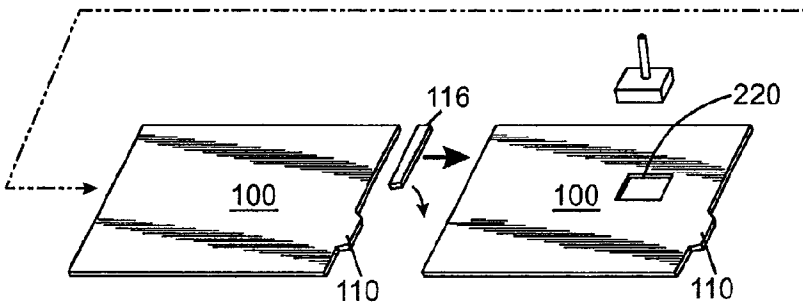
FIG. 2 is a perspective view of a document having two tab features located at a binding station.
Figure 2:
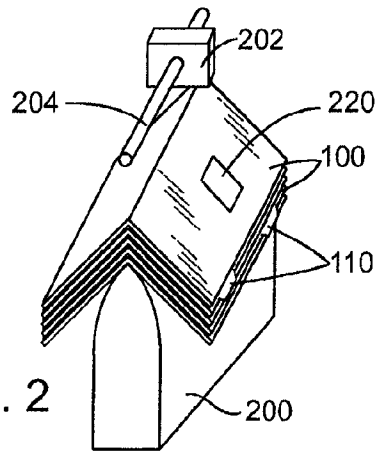

After the tab formation and trimming processes are completed, a plurality of sheets with and without tabs are assembled in a stacked arrangement at a binding station as shown in FIG. 2. The tabs 110 are preferably preprinted with indexing information prior to cutting away the excess material to form the tabs. The tabs 110 are preferably formed on sheets of card stock or other heavy weight paper for durability with the untabed pages of the documents formed on regular paper. The card stock for the tabs can be loaded into an alternate input tray of the printer and printed along with the regular sheets. The printing and collating of the sheets is automatic and controlled by the software of the controller or the associated printer. Alternatively, the tabs 110 may be formed on sheets of the same material as the untabed pages of the document. The punching system according to the present invention eliminates the need for expensive pre-tabbed or pre-notched card stock.

FIG. 2 illustrates a plurality of sheets 100 with and without tabs 110 stacked on a saddle 200 for binding. FIG. 2 illustrates a binding system in the form of a movable stapler 202 mounted on a rod 204 above the saddle 200 for stapling the folded and stacked sheets 100 at a plurality of locations along a spine of the document. The saddle 200 may include an active or passive clinch mechanism for operation with the stapler 202. Although a stapler binding system has been shown, any of the know binding systems may be used for binding the stacked sheets including using glue or adhesive, stapling, spiral binding, plastic comb binding, and any other binding methods.

For the embodiment illustrated in FIGS. 1 and 2 in which each of the sheets 100 is folded and bound at the center of the sheet the punch system should be capable of punching both the leading and trailing edges of the sheets. A punch system for punching both leading and trailing edges of the sheets is illustrated by way of example in FIG. 3 which will be discussed below.

Figure 3:
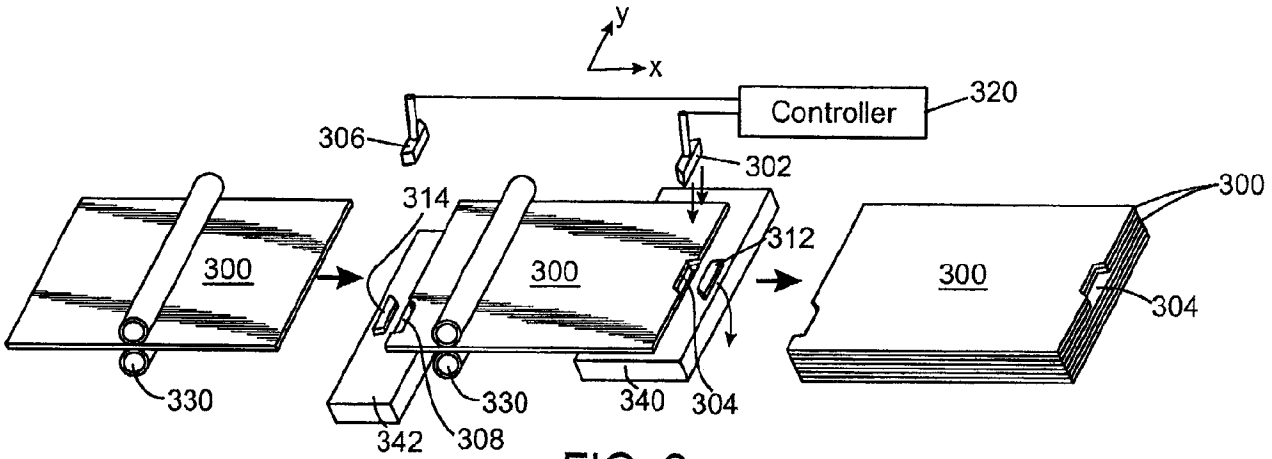
FIG. 3 is a perspective view of the steps of formation of a finger index feature on a plurality of sheets of a document.

FIG. 3 illustrates the steps for formation of a finger index on a plurality of sheets of a document. As shown in FIG. 3, the sheets 300 are transported along a sheet transport path to the location of a leading edge punch 302 and a trailing edge punch 306 which form notches 304 and 308 on the edges of the sheets. The punches 302 and 306 are each provided with a punch plate 340 and 342 as in the embodiment of FIG. 1. The punches 302 and 306 are controlled by a controller 320 which determines whether or not a notch is to be formed and a location for notching each sheet 300 in the Y direction based on the location of the sheet in the finished document.

As shown in FIG. 3, the leading and trailing edges of the sheets 300 are notched by the punches 302 and 306 having polygonal shapes to create polygonal shaped finger notches or indexes on the sheets. The punches 302 and 306 may be the same shape as the punch 102 used in FIG. 1 allowing the same punching system to be used for creating either tabs or finger indexes.

After the leading and trailing edges of the sheets 300 have been punched the sheets are passed to a stacking system such as a tray or saddle which collects the sheets for binding. The sheets are then bound with a binding system, such as the stapler unit shown in FIG. 2. The last full sheet in the stack adjacent to the punched sheets forming the finger index is preferably printed to identify a chapter, section, or other location in the document. The printing in the finger index can be viewed along an edge of the completed document. Information about the location and sheet numbers of the printed finger index information is transmitted to the binding system to correctly locate the finger index notches.

Figure 5:
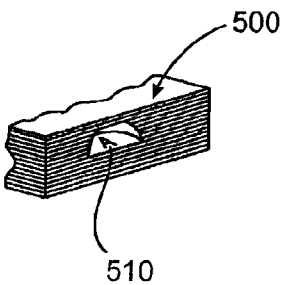
FIG. 5 is a perspective view of a portion of a document showing the semi-spherical finger index feature.
Figure 4:
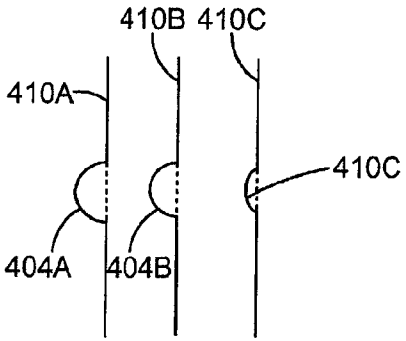
FIG. 4 is a top view of the edges of a sequence of sheets forming a semi-spherical finger index feature.

FIGS. 4 and 5 illustrate the formation of a semi-spherical shaped finger index cavity by punching the edges of successive sheets 410A, 410B, 410C with a semi-circular or circular punch positioned at a position such that a gradually changing amount of sheet material is removed. As shown in FIG. 4, a first sheet 410A of the finger index 400 is positioned in the punch and punched to form a substantially semi-circular notch 404A on the edge of the sheet. A second sheet 410B is punched by the punch to make a smaller notch 404B and a third sheet 410C and subsequent sheets are punched to make progressively smaller notches 404C. Although the notching of three sheets has been shown, any number of sheets may be notched at gradually varying notch depths to form a stack of sheets 500 with a finger index 510 as shown in FIG. 5. The resulting finger index 510 is useful for identifying lettered or numbered sections of a document or for other indexing. For example, the finger index of FIGS. 4 and 5 is particularly useful for dictionaries, address books, and phone books.

Figure 6:
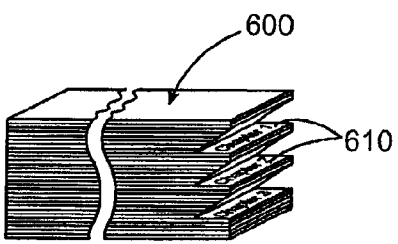
FIG. 6 is a perspective view of a portion of a document having a plurality of finger index features forming a saw-tooth edge.

FIG. 6 illustrates a plurality of stacked sheets 600 cut to form a sawtooth effect at the edge of a document. The sawtooth index 610 shown in FIG. 6 may be formed using the systems and methods described above with respect to FIGS. 3–5. By trimming the entire edge or a portion of the edge of a document the sawtooth effect can provide an easy chapter index. Printing can be done on the visible sheet to provide chapter or section information as illustrated in FIGS. 5 and 6.

The punching system and method of the present invention may be used for other notching and hole punching operations to add features to documents in a sheet-by-sheet manner. For example, the punching system and method may be used to form tear out cards or tear out pages by forming a line of perforations on a sheet. The perforations may be formed by a perforated punching wheel which operates in a manner similar to a rotary cutter or by other known punching methods. The invention may also be used to punch windows 220, as shown in FIGS. 1 and 2, such as a window for viewing a title through a cover of a booklet.

Precision positioning for punching and/or trimming of each sheet is achieved by a sheet transport system having a precision drive system such as those used in a low cost desktop printer. The formation of features according to the present invention is preferably used in combination with a trimming operation which trims each sheet to a unique and precise length so that the edge of the assembled document is flat except for the tabs and indexing features. The trimming operation is more important in folded booklets than in bound book type documents.

According to one embodiment, the controller 120, 320 employs an edge sensor, such as an optoelectronic sensor to sense an edge of a sheet. The sheet is moved precisely with respect to the sensed position of the edge to punch the sheet for formation of the features according to a schedule provided by the controller.

Although the invention has been described as employing a process of punching and trimming followed by folding, stacking, and binding, the order of the process steps may be varied as long as the formation of the features is performed on individual sheets prior to binding.

The systems used to load, align, register, and staple sheets in the binding system according to the present invention are those that are known to those in the field of desktop and commercial printers.

The invention may be used for making documents of any size. The term document as used herein is intended to mean documents of all sizes from small booklets of only a few sheets to large books with hundreds of pages.

The operation of a desktop booklet maker including the stacking, folding, stapling, and other operations is described in further detail in U.S. Pat. No. 6,099,225 and International Publication No. WO 00/18583 both of which are incorporated herein by reference in their entirety.

While the invention has been described in detail with reference to the preferred embodiments thereof, it will be apparent to one skilled in the art that various changes and modifications can be made and equivalents employed, without departing from the present invention.

What is claimed is:

1. A sheet-wise binding system comprising:

a sheet transport path for transporting a plurality of printed sheets in a sheet-wise manner;

a punch configured to punch a feature into at least one of the sheets traveling through the sheet transport path;

a stacking system for stacking the punched and unpunched sheets;

a binding system for binding the stacked sheets to form a finished document; and a controller programmed to control the sheet transport path and the punch to punch the feature in some of the sheets and not punch the feature in others of the sheets according to a punch schedule, wherein the controller controls the sheet transport path to locate and punch the feature at a varying depth, in a direction substantially parallel to the sheet transport path, on different pages of the finished document.

2. The system of claim 1, wherein the punch is configured to punch the edges of the sheets to form an edge feature.

3. The system of claim 2, wherein the edge feature is formed on leading and a trailing edges of the sheets.

4. The system of claim 2, wherein the edge feature is formed on the leading edges of the sheets.

5. The system of claim 2, wherein the edge feature is formed on the trailing edges of the sheets.

6. The system of claim 2, wherein the edge feature is a finger index.

7. The system of claim 6, wherein the finger index is semi-circular.

8. The system of claim 6, wherein the finger index is polygonal.

9. The system of claim 2, wherein the controller controls the punch to locate and punch the finger index at a varying depth on successive pages.

10. The system of claim 2, wherein the punch is configured to punch the edges of the sheets to form an edge feature in the form of an index tab.

11. The system of claim 1, wherein the binding system is a stapler.

12. The system of claim 1, wherein the binding system applies adhesive.

13. The system of claim 1, wherein the punch schedule of the controller determines whether or not to punch a sheet based on a location of the sheet in the stack of sheets.

14. The system of claim 1, wherein the punch is movable in a direction substantially parallel to an edge of the sheets being punched to locate the feature at a variable position along the edge.

15. The system of claim 1, wherein the punch is configured to punch a window in a sheet forming a cover of a document.

16. The system of claim 1, wherein the punch is configured to punch perforations to form a tear out card.

17. The system of claim 1, wherein the punch is configured to punch the edges of the sheets to form a saw tooth edge feature.

18. The system of claim 1, wherein the controller moves the punch in a first direction substantially perpendicular to an edge of the sheet on which the feature is to be formed, and also moves the punch in a second direction substantially parallel to the edge of the sheet in which the feature is formed.

19. A method of binding sheets to form a document, the method comprising:

delivering a plurality of sheets to a punch in a sheet-wise manner;

punching at least one of the sheets with the punch to form a feature according to a punching schedule by controlling a sheet transport path and the punch to punch the feature at a variable depth in a direction substantially perpendicular to an edge of the sheet on which the feature is to be formed;

stacking punched and unpunched sheets from the punch; and binding the stacked sheets to form a document, wherein the punching comprises:

moving the punch in a first direction substantially perpendicular to an edge of the sheet on which the feature is to be formed, and moving the punch in a second direction substantially parallel to the edge of the sheet in which the feature is to be formed.

20. The method of claim 19, wherein the step of punching forms an edge feature.

21. The method of claim 20, wherein the step of punching forms the edge feature on the leading and trailing edges of the sheets.

22. The method of claim 19, wherein the punching schedule indicates the page numbers to be punched and the location to be punched.

23. The method of claim 19, wherein the sheets are printed prior to punching.

24. The method of claim 19, wherein the punching schedule provides information for punching edge features at gradually varying depths.

25. The method of claim 19, wherein the method forms a plurality of features and the position along the length of the edge of the sheet for any one feature is substantially constant.

26. The method of claim 19, wherein the punch punches the feature at a position along a length of the edge of the sheet that is substantially constant between a portion of the plurality of sheets.

27. A sheet-wise binding system comprising:

a sheet transport path for transporting a plurality of printed sheets in a sheet-wise manner;

a trimmer configured to trim the edges of the sheets traveling through the sheet transport path to form a saw tooth edge feature;

a stacking system for stacking the trimmed sheets;

a binding system for binding the stacked sheets to form a finished document having the saw tooth edge feature; and a controller programmed to control the sheet transport path and the trimmer to trim the edges of the sheets at a varying depth according to a trim schedule to create the saw tooth edge feature, wherein the saw tooth edge feature includes a plurality of document portions, a first document portion including a plurality of trimmed sheets of a uniform first depth and a second document portion including a plurality of trimmed sheets of varying trimmed depths to expose a surface of a first visible trimmed sheet of an adjacent first document portion, wherein a portion of the trimmed sheet removed to the varying trimmed depth is an entire edge of the trimmed sheet.

28. The sheet-wise binding system of claim 27, comprising a plurality of saw tooth edge features.

* * * * *